United States Patent [19]

Wright

[11] 4,455,022

[45] Jun. 19, 1984

[54] MASTER SHAFT AND METHOD OF MAKING GOLF CLUB SHAFTS THEREFROM

[75] Inventor: Donald Wright, Beaverton, Oreg.

[73] Assignee: Don Wright Golf Company, Beaverton, Oreg.

[21] Appl. No.: 319,137

[22] Filed: Nov. 9, 1981

[51] Int. Cl.[3] ..... A63B 53/10

[52] U.S. Cl. ..... 273/77 A; 273/80 B; 273/DIG. 007; 428/36

[58] Field of Search ..... 273/80 B, DIG. 007, 273/77 A; 428/36

[56] References Cited

U.S. PATENT DOCUMENTS

| | | | |
|---|---|---|---|
| 1,594,801 | 8/1926 | Stackpole | 273/77 A |
| 2,934,345 | 4/1960 | Scott | 273/80 B |
| 3,313,541 | 4/1967 | Benkoczy et al. | 273/DIG. 007 |
| 3,963,236 | 6/1976 | Mann | 273/77 A |
| 4,122,593 | 10/1978 | Braly | 273/80 |
| 4,240,631 | 12/1980 | MacDougall | 273/77 A |

FOREIGN PATENT DOCUMENTS

| | | | |
|---|---|---|---|
| 1246539 | of 0000 | United Kingdom | 273/80 B |

*Primary Examiner*—George J. Marlo
*Attorney, Agent, or Firm*—Oliver D. Olson

[57] ABSTRACT

A hollow, tapered master shaft is made of glass fiber cloth impregnated with synthetic polyester resin and has a length of about 55 inches, a wall thickness of about 0.03–0.06 inch, a butt end outside diameter of about 0.80–0.88 inch and a tip end outside diameter of about 0.35–0.42 inch. A golf club shaft is made from this master shaft by cutting away a portion of the length of the master shaft, from one or both ends, to derive the desired length, flexure and butt and tip dimensions.

6 Claims, 5 Drawing Figures

MASTER SHAFT AND METHOD OF MAKING GOLF CLUB SHAFTS THEREFROM

BACKGROUND OF THE INVENTION

This invention relates to golf clubs, and more particularly to the production of golf club shafts from glass fiber impregnated with synthetic polyester resin.

Golf club shafts of polyester resin reinforced with glass fiber have not been satisfactory heretofore because they develop so much torque, i.e. rotational twisting about the longitudinal axis of the shaft, during the downswing that the club head attached thereto cannot be brought back to the initially aligned position at impact with the golf ball. This results in a struck golf ball being projected in such an array of unpredictable directions as to render the club totally unsuitable for play.

SUMMARY OF THE INVENTION

In its basic concept, this invention provides a hollow, tapered master shaft of glass fiber impregnated with synthetic polyester resin and of such dimensions as to afford the production from within its length of a golf club shaft of any desired length and flexure in which torque has been reduced to a magnitude that renders the club fully suitable for play.

It is the principal object of this invention to provide a golf club shaft of glass fiber impregnated with synthetic polyester resin and characterized by developing torque during the downswing sufficient to drive a golf ball to distances farther than with conventional golf club shafts, but insufficient to cause misalignment of the golf club head at impact with the golf ball.

Another object of the invention is to provide a method of making a golf club shaft of the character described above.

A further object of this invention is the provision of a master shaft a plurality of which may be cut off at one or both ends to provide a full set of golf club shafts or desired lengths and flexures.

The foregoing and other objects and advantages of this invention will appear from the following detailed description taken in connection with the accompanying drawing of a preferred embodiment.

BRIEF DESCRIPTION OF THE DRAWING

FIG. 2 is a longitudinal view showing in broken lines a portion of the butt end of the master shaft removed to produce a golf club shaft of desired length having maximum flexibility.

FIG. 3 is a longitudinal view showing in broken lines a portion of the tip end of the master shaft removed to produce a golf club shaft of desired length having minimum flexibility.

FIG. 4 is a longitudinal view showing in broken lines portions of both the butt end and tip end of the master shaft removed to produce a golf club shaft of desired length having an intermediate degree of flexibility.

FIG. 5 is a longitudinal view of a master shaft in accordance with this invention.

DESCRIPTION OF THE PREFERRED EMBODIMENT

Figure 1:
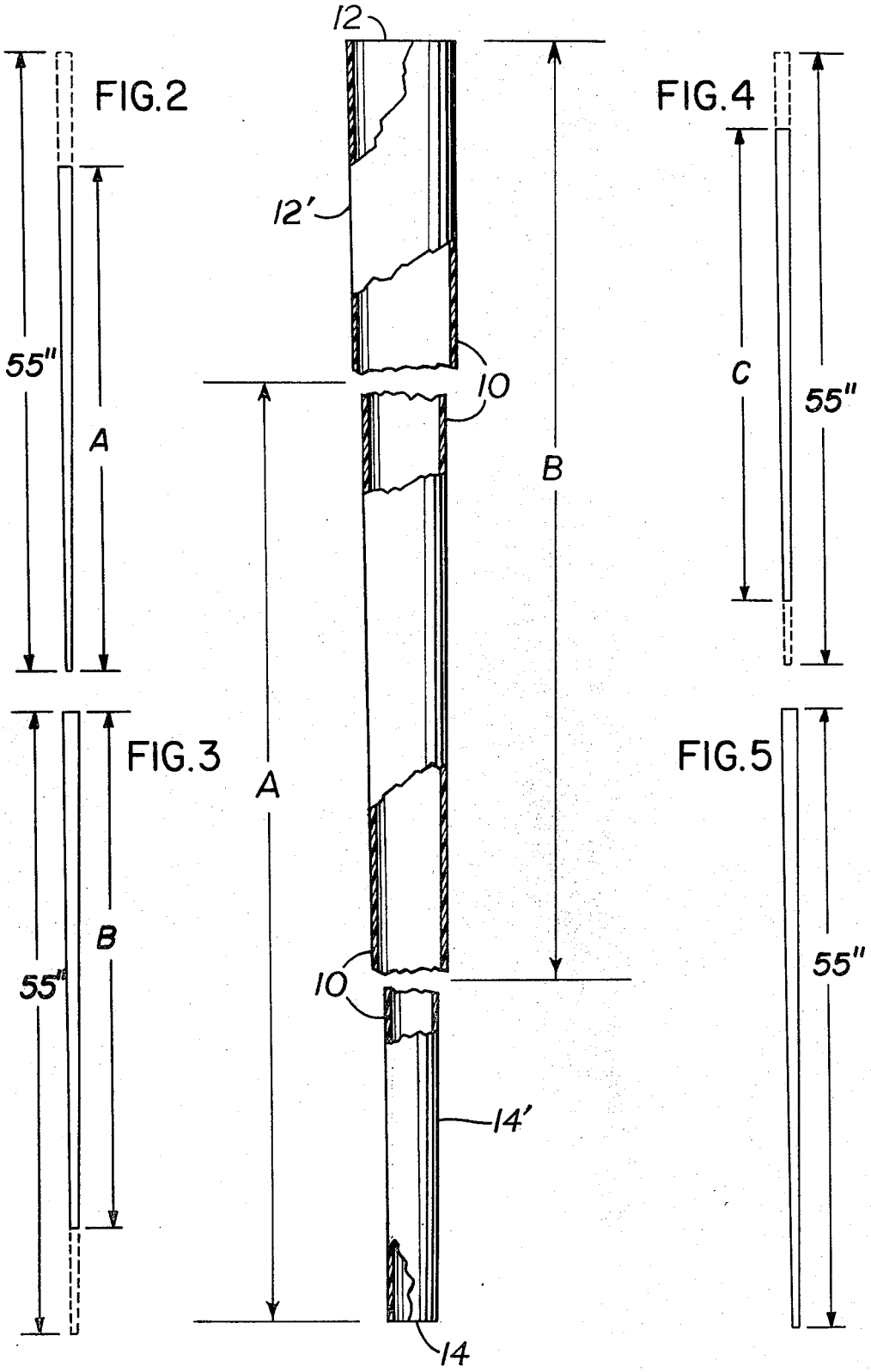
FIG. 1 is a foreshortened longitudinal section of a master shaft embodying the features of this invention.

As previously mentioned, this invention is directed to the provision of golf club shafts made of glass fiber impregnated with synthetic polyester resin which, unlike such shafts provided heretofore, derives a magnitude of torque during a downswing which is sufficient to effectuate the driving of a golf ball to greater distances than with conventional shafts, but which is sufficiently limited so that a golf club head attached to the shaft is brought back reliably and reproducibly to the initially aligned position at impact with a golf ball.

The foregoing is achieved in accordance with this invention by providing a hollow, tapered master shaft of specific construction from the length of which a golf club shaft of any desired regulation length and flexure may be derived. That is to say, the master shaft is formed of a length considerably greater than the longest regulation length of any golf club shaft. It is also formed with a wall thickness, butt end diameter and tip end diameter such that it may provide within its length the entire range of golf club shaft lengths and flexures.

Accordingly, a plurality of such master shafts may serve to derive a complete set of wood and iron golf club shafts of any desired flexure, from very stiff to very flexible, within the conventional range of lengths from the regulation length of about 43 inches (109 cm) for a wood driver to the regulation length of about 34 inches (86 cm) for an iron wedge.

Referring to FIG. 1 of the drawing, there is illustrated in foreshortened section the hollow, tapered master shaft 10 of this invention. It is formed by the impregnation of glass fiber cloth of fabric with synthetic polyester resin, in accordance with well known techniques. Any of the known synthetic polyester resins may be employed for this purpose. Although the specifications for glass cloth or fabric may vary over a considerable range, the following two examples have been found to provide satisfactory results for the purpose of this invention:

One glass cloth is 0.016 inch (0.4 mm) thick; its dry weight is 8.94 ounces per square yard (303 grams per square meter); its weight when pre-impregnated with synthetic polyester resin is 12.4 ounces per square yard (421 grams per square meter); and its thread count is 48 x 30 per inch square (19 x 12 per cm square).

A second glass cloth is 0.011 inch (0.28mm) thick; its dry weight is 5.56 ounces per square yard (189 grams per square meter); its weight when pre-impregnated with synthetic polyester resin is 7.8 ounces per square yard (265 grams per square meter); and its thread count is 57 x 30 per square (22 x 12 per cm square).

It has been found that a master shaft 10 capable of providing within its length any one shaft of a full set of golf club shafts of any desired flexure, has the following specifications: It is about 55 inches (140 cm) long and its wall thickness preferably is about 0.036 inch (1 mm), although it may range between about 0.03 and 0.06 inch (0.75 and 1.5 mm). The butt end 12 of the master shaft preferably is about 0.825 inch (2.1 cm) in outside diameter, although it may range between about 0.80 and 0.88 inch (2.0 and 2.24 cm). The tip end 14 of the shaft preferably is about 0.375 inch (0.95 cm) in outside diameter, although it may range between about 0.35 and 0.42 inch (0.89 and 1.07 cm).

With regard to the foregoing specifications, the operative length of the master shaft of 55 inches allows the production from within said length of all said regulation lengths of golf club shafts. A length substantially less than 55 inches precludes this production, and a length significantly greater is wasteful of shaft material. The range of butt end and tip end diameters for the master shaft provides the proper maximum dimensions for hand grips at the larger diameter end and minimum club head connections at the smaller diameter end.

The range of wall thicknesses cooperates with the diameters at various positions along the length of the master shaft to provide the desired flexure for all club shafts produced therefrom. Thinner wall sections produce impracticably high flexure and torque, and thicker wall sections produce shafts which are too stiff and too heavy. If desired, the wall thickness may be greater at the butt end and tapered to lesser thickness at the tip end. For example, the wall thickness may taper from about 0.04 inch (1 mm) at the butt end to about 0.03 inch (0.76 mm) at the tip end.

The drawing illustrates in FIGS. 1 and 2 a length A extending from the tip end 14 toward the butt end 12. This length denotes the length of any desired golf club shaft, within the conventional range of lengths, which provides maximum flexure of such shaft. The length B in FIGS. 1 and 3 extending from the butt end 12 toward the tip end 14 denotes the length of any desired golf club shaft which provides minimum flexure of such shaft.

Accordingly, it will be appreciated that golf club shafts of any desired length C and flexure between such minimum and maximum flexures may be produced within the length of the master shaft by cutting away various lengths of both butt and tip portions 12' and 14', as illustrated in FIG. 4.

Having thus produced a desired golf club shaft from each master shaft 10, the tip end is secured to the appropriate golf club head and the butt end is fitted with an appropriate hand grip. The desired golf club thus is completed.

Comparative tests have been conducted in which identical golf club heads were fitted one to a conventional steel golf club shaft and the other to a golf club shaft of this invention having the same length and flexure of the steel shaft. The shaft of this invention was shown to provide between 10 and 20% greater golf ball driving distance with substantially the same direction accuracy.

It will be apparent to those skilled in the art that various changes may be made in the structural details described hereinbefore without departing from the spirit of this invention and the scope of the appended claims.

Having now described my invention and the manner in which it may be used, I claim:

1. The method of making a golf club shaft, comprising forming a hollow, tapered master shaft of glass fiber impregnated with synthetic polyester resin and having an operative length of 55 inches, a wall thickness of 0.03–0.06 inch, a butt end having an outside diameter of 0.80–0.88 inch and a tip end having an outside diameter of 0.35–0.42 inch, and removing a portion of thelength of said master shaft from one or both ends thereof to produce a golf club shaft of predetermined length and flexure.

2. The method of claim 1 wherein the removed portion of the master shaft is from the butt end only, whereby to produce a golf club shaft of maximum flexure.

3. The method of claim 1 wherein the removed portion of the master shaft is from the tip end only, whereby to produce a golf club shaft of minimum flexure.

4. The method of claim 1 wherein the removed portion of the master shaft is from both butt and tip ends, whereby to produce a golf club shaft of predetermined flexure intermediate the maximum and minimum flexures.

5. For use in making a golf club shaft, a hollow, tapered master shaft of glass fiber impregnated with synthetic polyester resin having an operative length of 55 inches, a wall thickness of 0.03–0.06 inch, a butt end having an outside diameter of 0.08–0.88 inch and a tip end having an outside diameter of 0.35–0.42 inch.

6. The master shaft of claim 5 wherein the wall thickness is 0.036 inch, the outside diameter of the butt end is 0.825 inch and the outside diameter of the tip end is 0.375 inch.

* * * * *